United States Patent [19]

Kobayashi et al.

[11] Patent Number: 5,022,454

[45] Date of Patent: Jun. 11, 1991

[54] MULTI-PANEL COLLAPSIBLE DOOR ASSEMBLY HAVING A DOOR STORAGE SYSTEM

[75] Inventors: Mitsuru Kobayashi, Komagane; Keishirou Hori, Ina, both of Japan

[73] Assignee: Toyo Exterior Kabushiki Kaisha, Tokyo, Japan

[21] Appl. No.: 429,365

[22] Filed: Oct. 31, 1989

[30] Foreign Application Priority Data

Aug. 31, 1989 [JP] Japan ..... 1-225051

[51] Int. Cl.[5] ..... E05D 15/00

[52] U.S. Cl. ..... 160/202; 160/197; 49/125; 49/127

[58] Field of Search ..... 160/202, 196.1, 197, 160/199, 211, 221, 223, 26, 32, 33, 188, 201; 52/64, 71; 49/125, 127, 128

[56] References Cited

U.S. PATENT DOCUMENTS

| | | | |
|---|---|---|---|
| 1,960,860 | 5/1934 | Allen | 160/196.1 X |
| 3,071,825 | 1/1963 | Ferris | 160/196.1 X |
| 3,334,375 | 8/1967 | Hubbard | 49/127 X |
| 3,394,496 | 7/1968 | Pulaski | 49/127 |
| 4,569,164 | 2/1986 | Dickson | 160/196.1 X |

FOREIGN PATENT DOCUMENTS 61-40985 2/1986 Japan .

64-6484 1/1989 Japan .

*Primary Examiner*—David M. Purol

*Attorney, Agent, or Firm*—Wenderoth, Lind & Ponack

[57] ABSTRACT

A collapsible double door assembly includes a number of serially connected panels each provided with a pair of inwardly and outwardly deviated pivotal suspension rollers, a horizontal guide rail constituted by an inner rail member and an outer rail member arranged in parallel in close proximity for separately guiding the suspension rollers, and one or two door storage areas extending perpendicularly from the guide rail at one or both ends thereof and formed by separating and independently bending the two rail members with different radiuses of curvature each defining an arc of a quarter of a circle. The radius of curvature of the outer rail member is relatively greater than that of the inner rail member. The distance between the two rail members in a door storage area is slightly smaller than the distance between the two suspension rollers of a panel. With such an arrangement, each panel of the double doors can be freely twisted by independently varying the angle of pivotal movement of each of the suspension rollers of the panel. Consequently, the panels can be moved into or pulled out of the storage areas very smoothly, particularly because the panels are stored in the storage areas in a slightly twisted state.

5 Claims, 7 Drawing Sheets

MULTI-PANEL COLLAPSIBLE DOOR ASSEMBLY HAVING A DOOR STORAGE SYSTEM

BACKGROUND OF THE INVENTION

1. Field of the Invention

This invention relates to a multi-panel collapsible door assembly having a door storage system that can be installed in an opening of a building.

2. Prior Art

A multi-panel collapsible door assembly having a door storage system for storing one or more door constituted by a number of serially connected panels in a totally collapsed condition has been proposed as an alternative for foldable door assemblies.

There have been disclosed a number of systems of this category, e.g. in Japanese Patent Publication No. 61-40985 and No. 64-6484 that teach various panel connector devices. These disclosures are directed to various devices for serially connecting a number of panels that form a sliding door in such a manner that the panels may be totally collapsed, each panel carrying such a device rigidly fitted to an end close to an adjacent panel.

While such a collapsible sliding door is normally suspended from and moved along a guide rail running above the door and is stored in a door storage area in a collapsed condition when it is not used, the storage area is in the form of a diamond as viewed from above, with the guide rail separated into two members and extending slanted or in an inclined manner from the guide rail into the space of the room where the door assembly is installed, making the configuration of the storage area unusual and inconvenient for daily use.

Such a diamond-shaped storage area is formed mainly for mechanical reasons in terms of the length of the movable connector used for connecting a pair of adjacent panels, the range of sliding movement of the movable connector, and other factors.

However, with such a conventional collapsible sliding door assembly, since the storage areas are realized in the form of a diamond as viewed from above, the space required for the storage areas inevitably is large, particularly when a sliding door is constituted by a large number of panels. Such door storage area is located inside the room, and since the diagonal of the diamond-shaped door storage area for the door becomes very large, consequently the effective space of the room is significantly reduced.

Moreover, a series of experiments of repeatedly closing and opening the doors of collapsible sliding door assemblies of various conventional types proved that panels can be blocked near the end of their respective guide rails, making door collapsing and storing operations not smooth and unsatisfactory.

It is therefore an object of the present invention to provide a multi-panel collapsible door assembly having a door storage system with one or more door storage areas perpendicularly extending from the guide rails for guiding the door panels, such that the panels are smoothly moved into and pulled out of the storage areas, and where the panels are stored almost parallel with the guide rails in a totally collapsed condition.

SUMMARY OF THE INVENTION

The inventors of the present invention, as a result of intensive research efforts to achieve the above and other objects of the invention, determined that a multi-panel collapsible door assembly having door storage areas extending perpendicularly from the guide rails can be effectively realized by separating each guide rail at the entrance of the related storage area into two branches, each of which is roundly bent to form an arc equal to a quarter of a circle, by making the radius of curvature of the inner branch smaller than that of the outer branch, and by reducing the distance between the two branches to a value slightly smaller than the distance between two suspension rollers suspending a panel for movement along the guide rails. More specifically, according to the invention, the above objects are achieved by providing a collapsible double door assembly comprising a number of serially connected panels each provided with a pair of inwardly and outwardly deviated pivotal suspension rollers, a horizontal guide rail formed by an inner rail member and an outer rail member arranged in parallel in close proximity for separately guiding the pair of suspension rollers, and one or two door storage areas extending perpendicularly from the guide rail at one or both opposite ends thereof and formed by separating and independently bending the two rail members at different radiuses of curvature each forming an arc of a quarter of a circle, the radius of curvature of the outer rail member being relatively greater than that of the inner rail member, and the distance between the two rail members in a door storage area being slightly smaller than the distance between the two suspension rollers of a panel.

It should be noted that the above described multi-panel collapsible door assembly has door storage areas located within the room in which the door assembly is installed. When the door storage areas are arranged outside the room, the inner rail members in the above description should be replaced by the outer rail members, and vice versa. Likewise, a pair of suspension rollers attached to a panel should be deviated from the lateral center line of the panel conversely to the above description.

Since the front or leading suspension roller of a pair of suspension rollers attached to a panel is introduced and pivotally moved into the related door storage area in advance of the rear or trailing suspension roller, the panel is twisted with the two rollers at different angles of pivotal movement so that the panel can smoothly enter the storage area without jolting.

Moreover, since the distance between the inner and outer rail members in the storage area is slightly smaller than the distance between the two suspension rollers of a panel, the rear or trailing suspension roller of a panel is introduced into the related storage area after the introduction of the front or leading suspension roller, at a little lag, the leading roller being held by the outer guide rail member, so that the panel is stored in the storage area in a slightly twisted state. Therefore, when the panel is pulled out of the storage area, the trailing suspension roller which is located nearer to the curved portion of the rail member can be moved to that portion having a relatively small radius of curvature without difficulty as it can pivotally move independently of pivoting of the front suspension roller moving behind it.

The present invention now will be described in greater detail by referring to the accompanying drawings that illustrate a preferred embodiment of the invention.

DETAILED DESCRIPTION OF THE INVENTION

Figure 1:
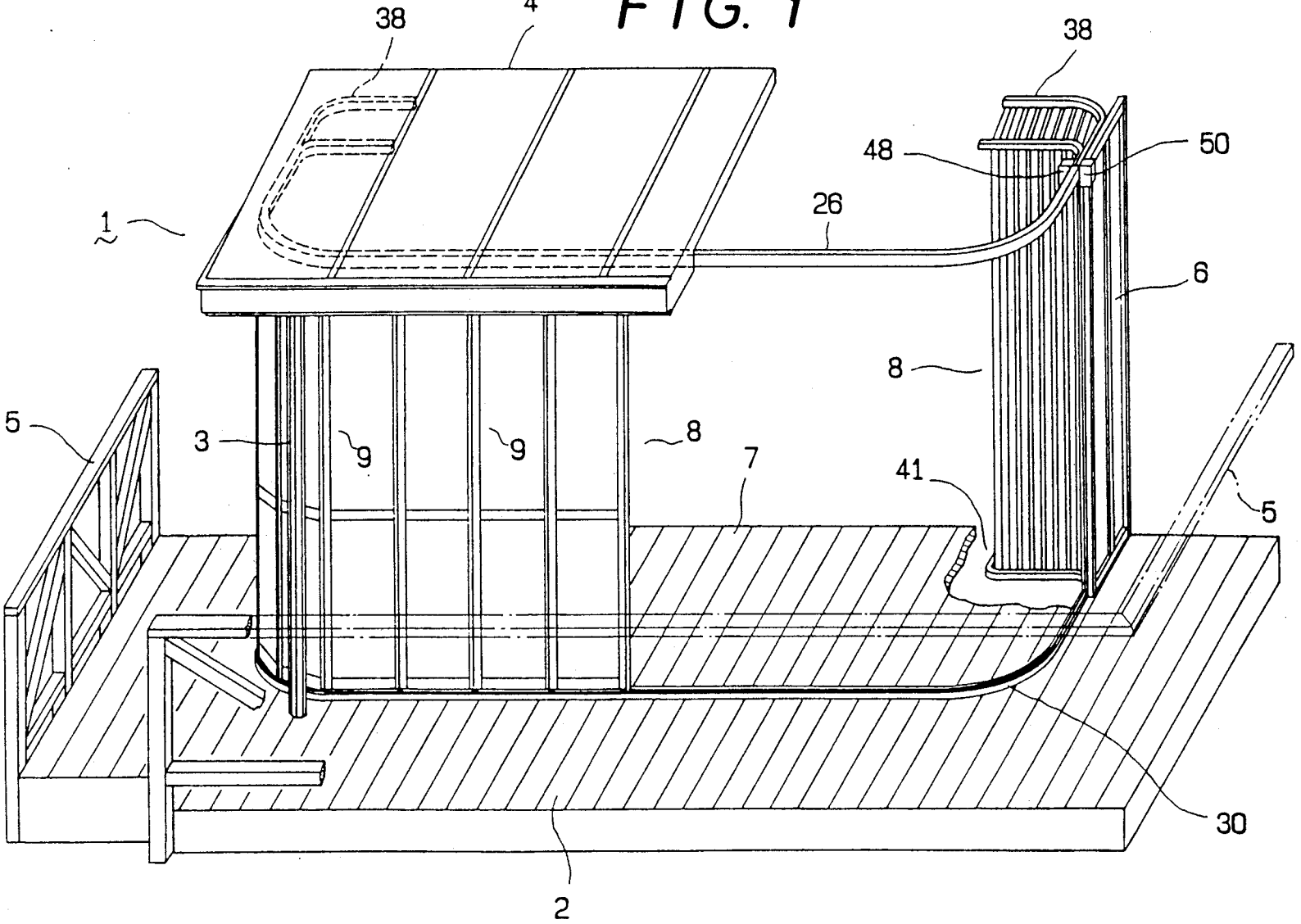
FIG. 1 is a partially exploded perspective view of a fully openable sun parlor provided with a multi-panel collapsible double door assembly having a pair of door storage areas according to the invention.
Figure 2:
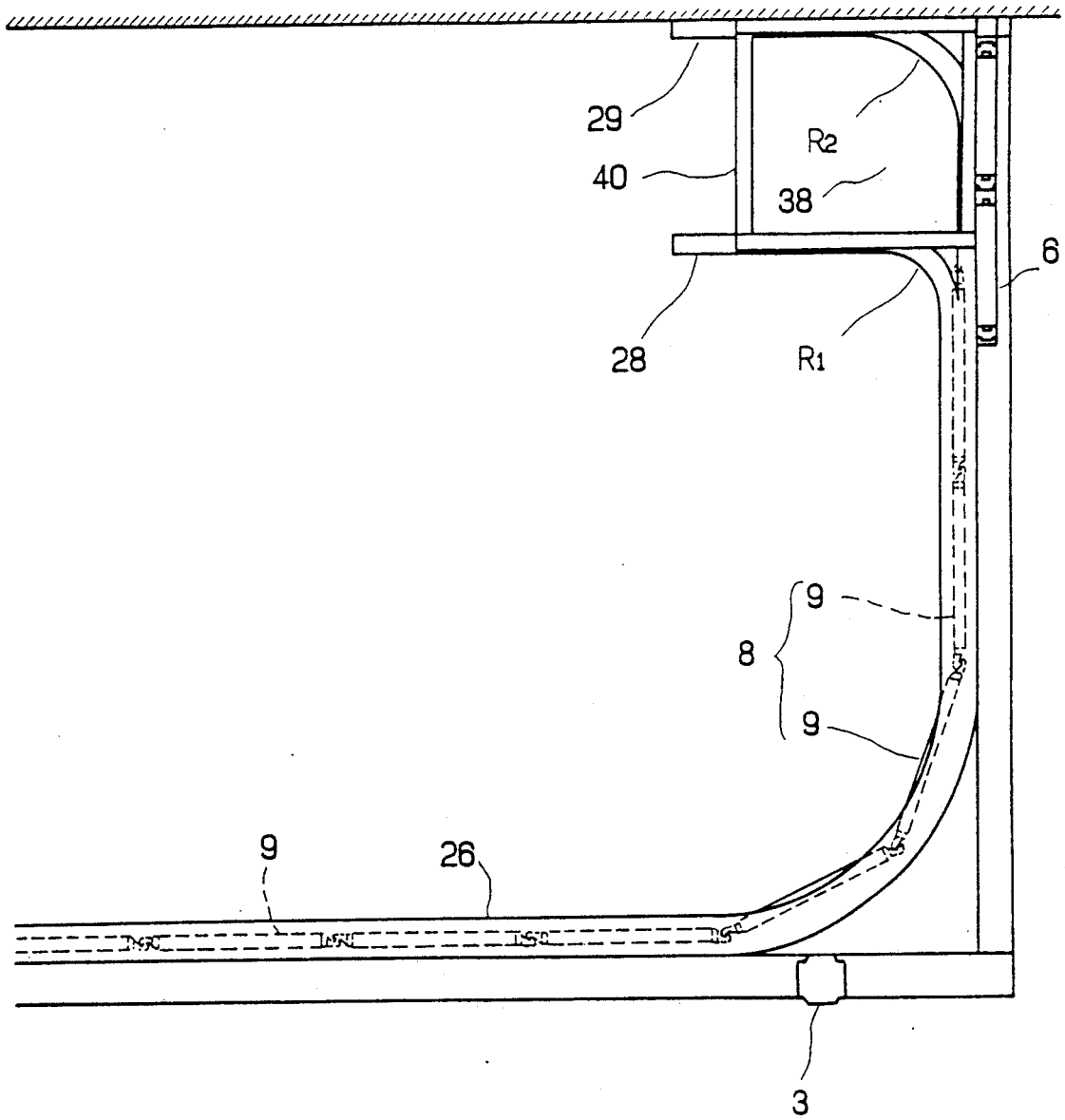
FIG. 2 is a partial plan view of the embodiment of FIG. 1, showing the relationship between an upper guide rail of the door assembly and one of the door storage areas.
Figure 3:
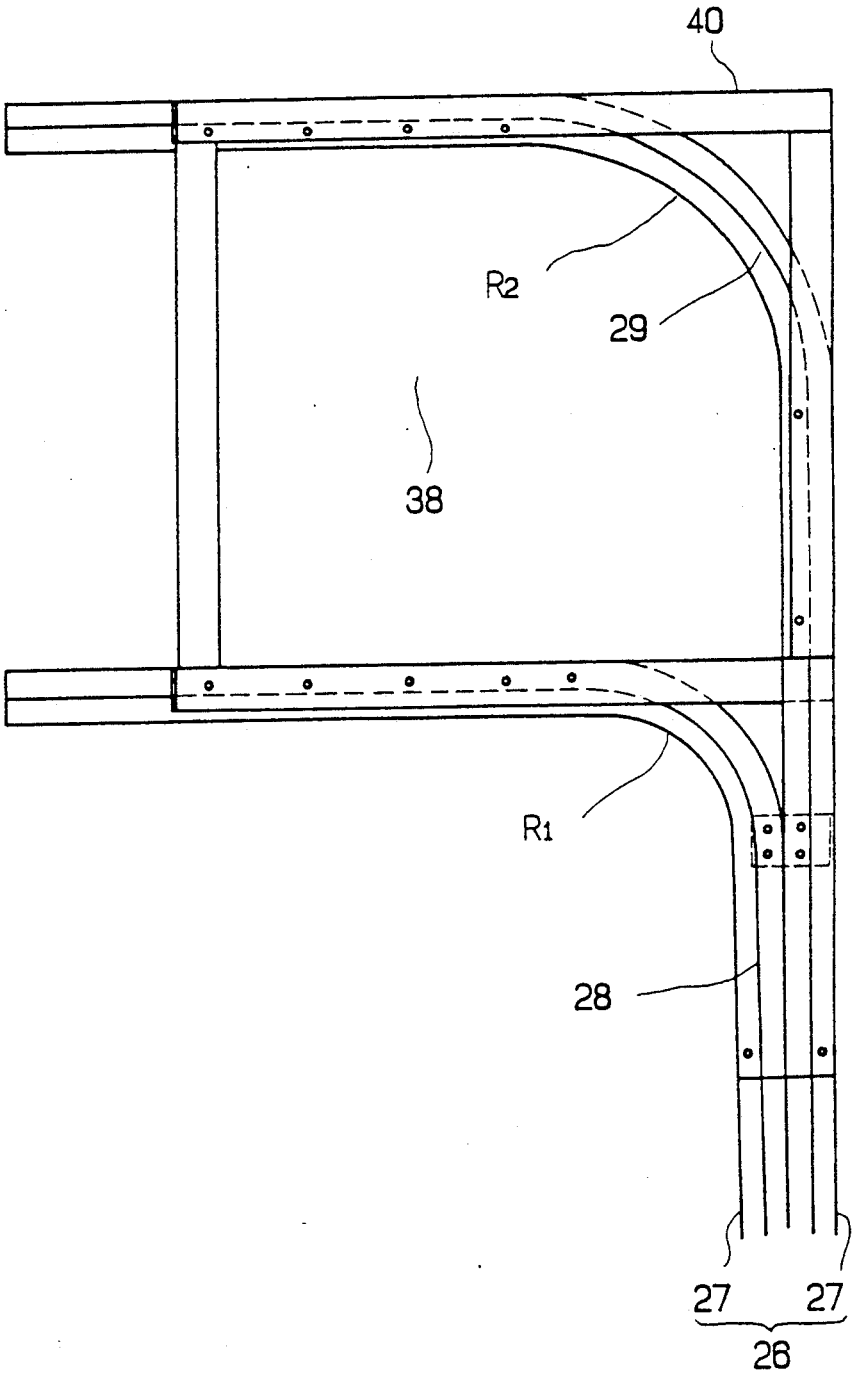
FIG. 3 is a plan view showing a principal portion of the embodiment of FIG. 1 on enlarged scale.
Figure 4:
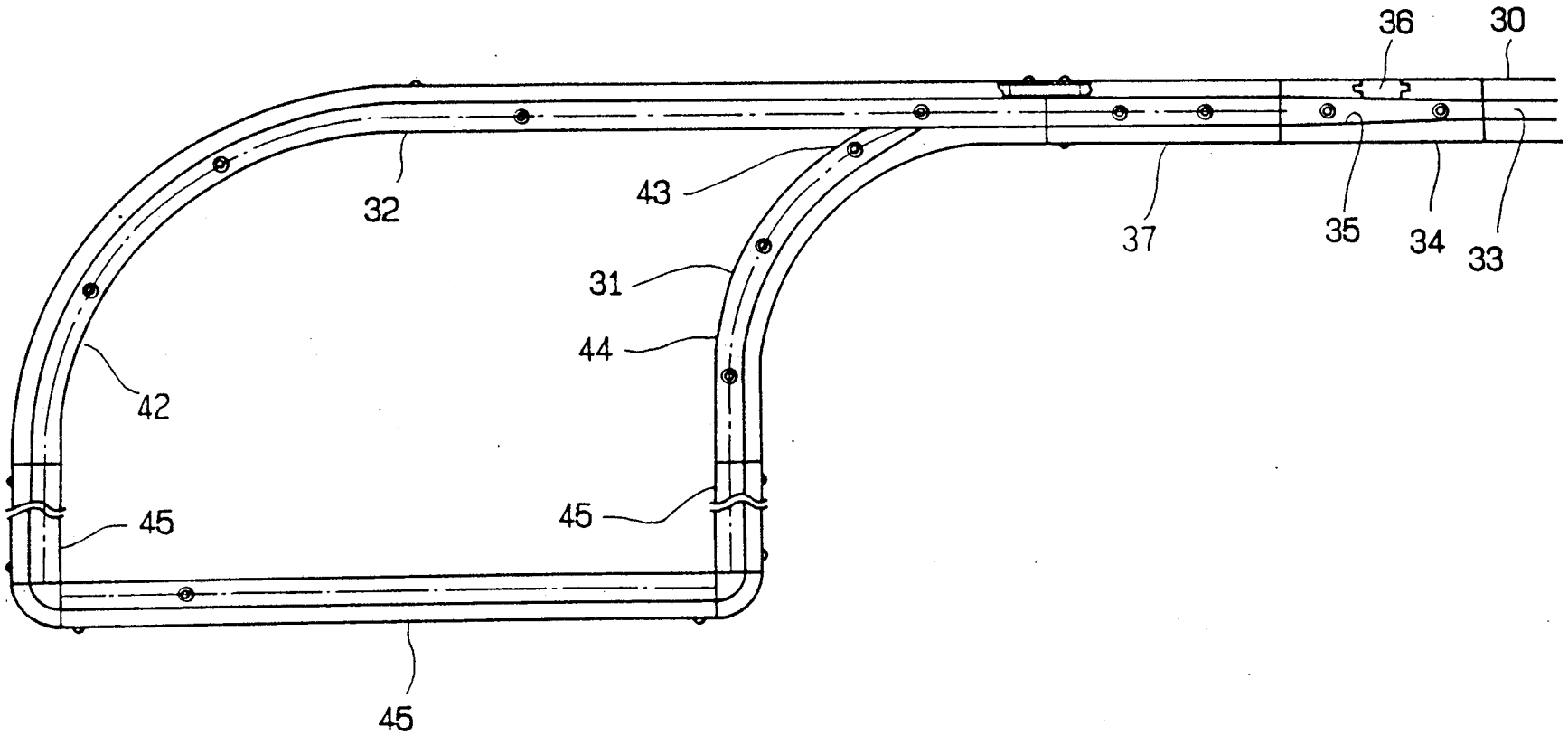
FIG. 4 is a partial plan view of the embodiment of FIG. 1, showing the relationship between a lower guide rail of the door assembly and one of the door storage areas.

In the drawings, reference numeral 1 generally denotes a sun parlor formed on an open deck 2 extending from the floor of a main building and provided with a fully openable multi-panel double door assembly according to the present invention. Sun parlor 1 comprises a roof 4 supported by a number of pillars 3 and rigidly fitted to the outer wall of the main building to which it is attached, a U-shaped horizontal upper guide rail 26 provided on the lower surface of the roof 4, a U-shaped horizontal lower guide rail 30 provided on the upper surface of the deck 2 and a pair of collapsible sliding doors arranged between upper and lower rails or tracks 26 and 30 and designed to be opened in opposite directions.

Each of the collapsible sliding doors 8 comprises a number of panels 9 arranged side by side, each of which is separably connected with a succeeding adjacent panel by means of upper and lower slide connector sets 13 that connect a rear vertical member 18 of one panel with a corresponding front vertical member 18 of a succeeding or adjacent panel.

More specifically, two neighboring or adjacent panels of a door are connected with each other in the following manner. Each panel is reinforced by an upper horizontal member 10 and a lower horizontal member 17, each of such members having a guide channel 11 extending horizontally all the way along the side wall of the member and facing the inside of the sun parlor 1. A slider 14 made of a resin block is introduced into each channel 11 by way of an enlarged opening at an end of a corresponding member 10 or 17, such that the slider is slidably contained in guide channel 11 with such opening closed by a cap 12. Slider 14 is then movably connected with the inside of the rear vertical member 18 of an adjacent panel by means of a wire 15 with a given length, slider 14 and wire 15 constituting a connector set 13. By appropriately defining the length of the wire 15, the two neighboring or adjacent panels can be brought into a totally collapsed condition without disconnecting the connector sets 13.

Figure 5:
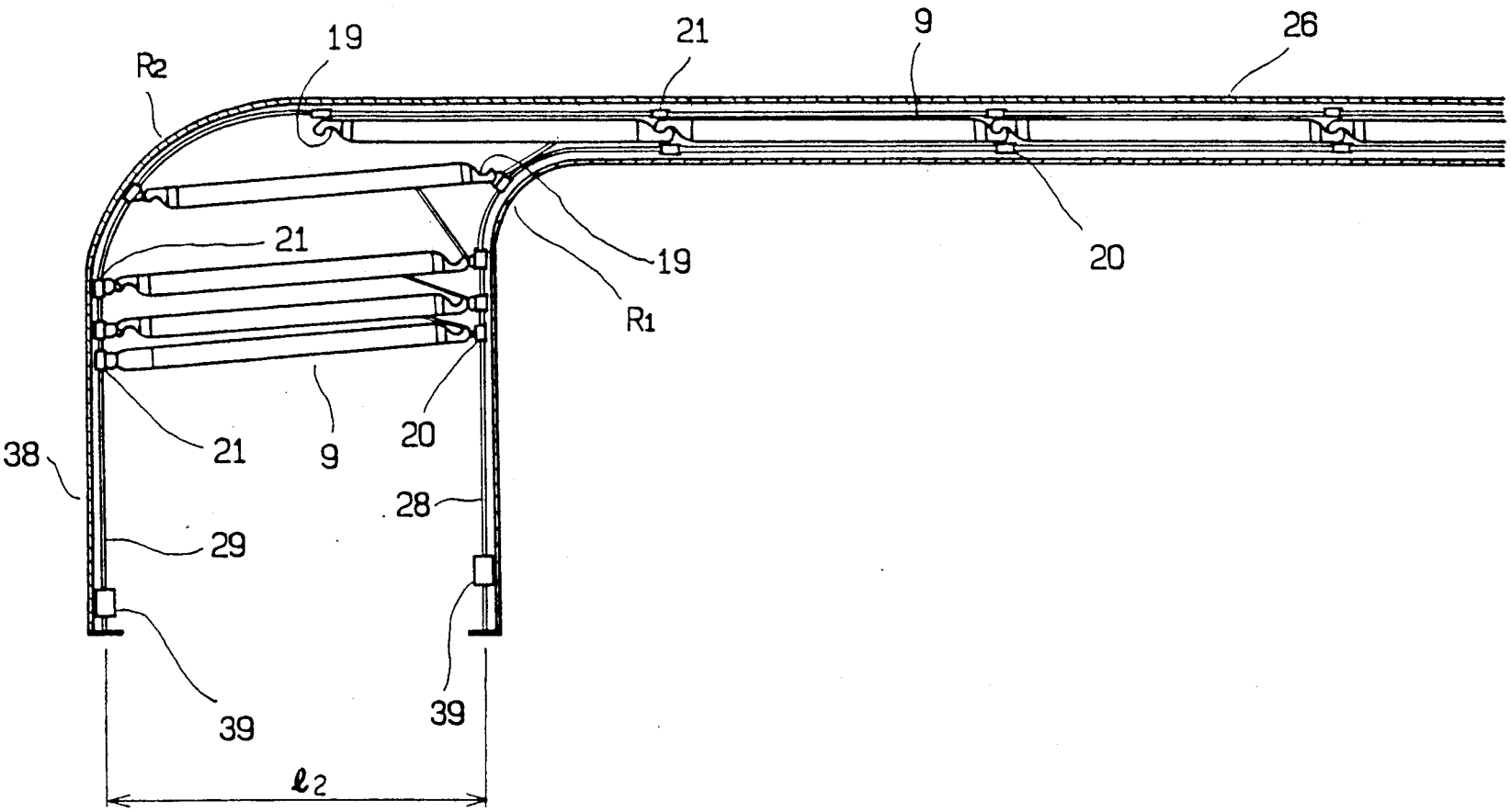
FIG. 5 is a partial sectional view of the embodiment of FIG. 1, showing the relationship between a top portion of one of the door storage areas and the panels constituting a sliding door.
Figure 6:
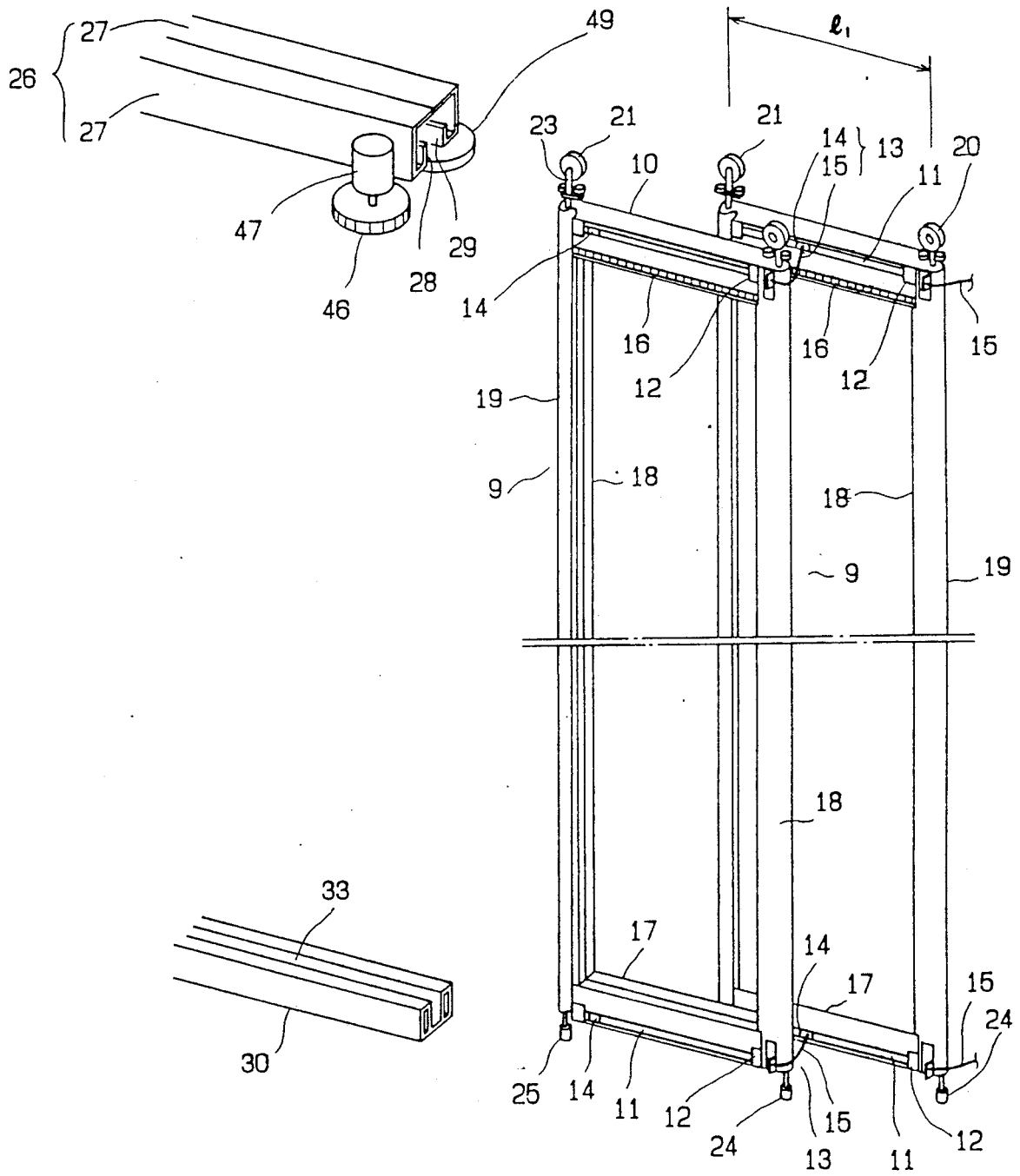
FIG. 6 is a perspective exploded view illustrating how adjacent panels of a sliding door of the door assembly are connected with each other.
Figure 7:
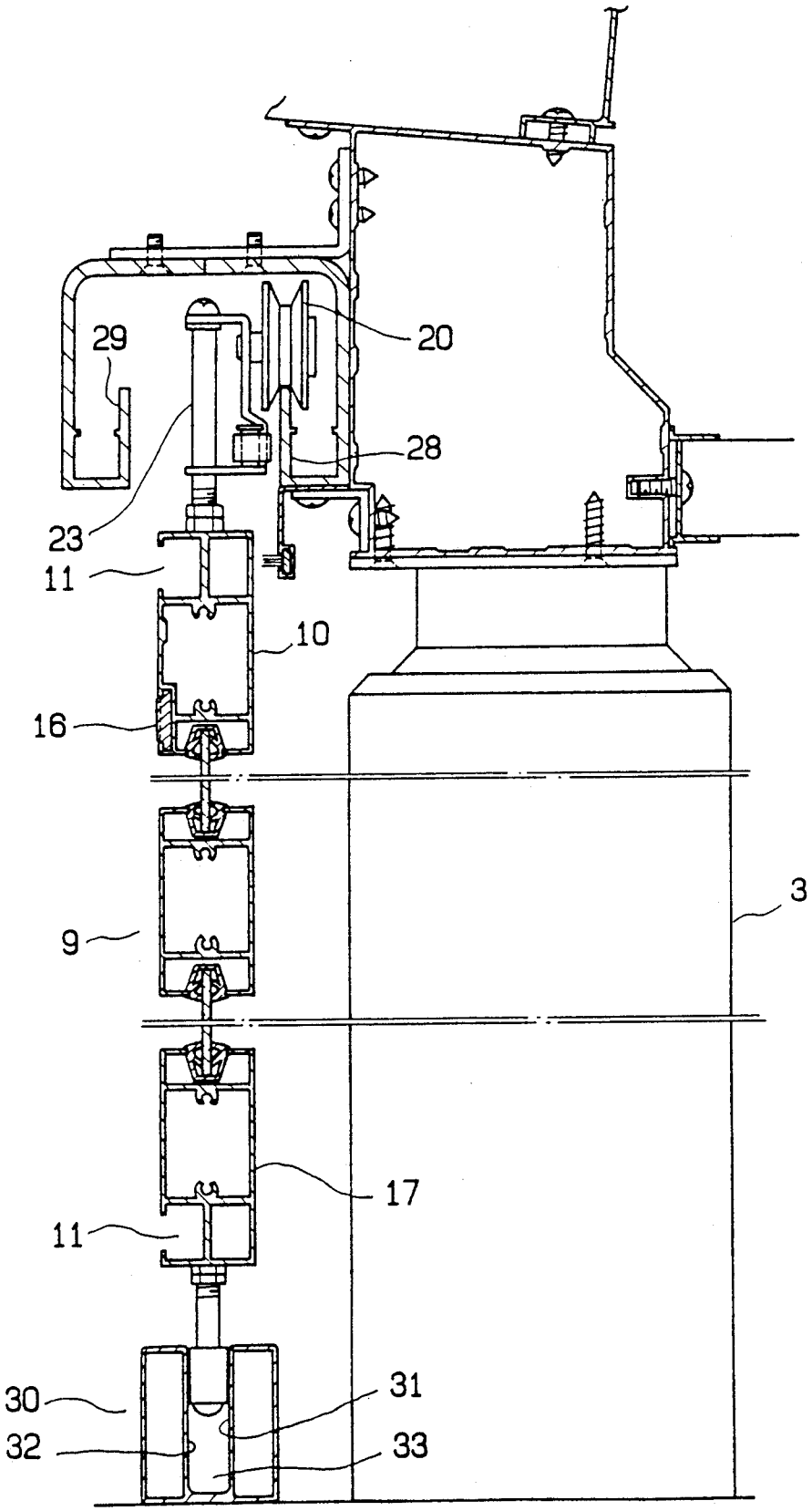
FIG. 7 is an enlarged vertical sectional view of the embodiment of FIG. 1 long a vertical center line thereof.

The front and rear vertical members 18 of a panel are identically formed, each being provided with an engaging member 19 extending longitudinally entirely along the height of vertical member 18 and having a C-shaped such that the engaging member 19 of the rear vertical member 18 of one panel 9 comes into engagement with its counterpart 19 combined with the front vertical member 18 of the succeeding or adjacent panel 9, as illustrated in FIG. 5. With such an arrangement, a force to pull the collapsible door 8 is effectively transmitted to all the panels 9 of the door, whereas the engagement of any pair of engaging members 19 easily can be relieved when the door 8 is collapsed.

Reference numerals 20 and 21 denote a pair of suspension rollers arranged at the top of each panel 9 for suspending the panel 9 from rail 26 and extending from and fitted to the top portions of the vertical members 18 of the panel 9 with a distance or horizontal space $1_1$ provided therebetween. Each of suspension rollers 20 and 21 is vertically and rotatably supported by a post 23 upwardly projecting from the longitudinal center line of the upper member 10 in such a manner that the roller can be displaced inwardly or outwardly and pivoted around the post 23. It should be noted that, in the present embodiment, a pair of lower rollers 24 and 25 which are rotatable around respective vertical shafts are respectively provided at the bottom portions of the vertical members 18 such that the lower rollers 24 and 25 are respectively located right beneath the suspension rollers 20 and 21.

The pair of collapsible sliding doors 8, each comprising a number of panels and having an arrangement as described above, are suspended from U-shaped horizontal upper guide rail 26.

More specifically, the upper guide rail 26 comprises an inner guide rail member 28 and an outer guide rail member 29 which are arranged in parallel with a short distance therebetween and connected with each other by means of a pair of guide rail connecting members 27, inner rail 28 and outer rail 29 supporting the pair of suspension rollers 20 and 21 of each panel, such that the panel 9 suspended by such rollers may be moved in opposite directions for closing or opening the door assembly.

Of the suspension roller pair 20 and 21, the suspension roller 21 which is located nearer to an upper door storage section 38 of a related door storage area is placed on the outer guide rail 29 and the other suspension roller 20 is placed on the inner guide rail 28, so that each of the pair of suspension rollers 20 and 21 may be independently displaced either upwardly or outwardly and moved along the related guide rail 28 or 29.

The lower guide rail 30 comprises an inner side wall 31, an outer side wall 32 and a recess 33 which are so arranged that the lower guide rail 30 as a whole has a U-shaped cross section, and the pair of lower rollers 24 and 25 which are located under the longitudinal center line of the lower member 17 are received in a recess 33 of the lower guide rail 30 for guiding the opening or closing motion of the door.

Reference numerals 34 and 37 in the drawings respectively denote a pair of connecting rail sections or members arranged between the lower guide rail 30 and a lower door storage section 41 of the related door storage area. The connecting member 34 located nearer to the lower guide rail 30 is provided with a tapered guide section 35 for forming a smooth transition area from the narrower recess 33 of the lower guide rail 30 to a broader recess of the connecting member 37. Connecting member 34 further comprises a vertically removable resin block 36 having an oblong water drain port. Block 36 forms a dust outlet when removed from the connecting member 34.

The upper guide rail 26 and the lower guide rail 30 are connected at respective opposite ends thereof with a pair of upper door storage sections 38 and a pair of lower door storage sections 41, respectively, of a pair of door storage areas that extend inwardly and perpendicularly from the respective guide rails so that the right and left collapsible doors 8 are stored in respective right and left door storage areas.

More specifically, at each opposite end of the U-shaped upper guide rail 26, at positions where the rail is perpendicular to the front of the sun parlor and parallel to the lateral sides thereof, the outer guide rail member 29 is extended further in a straight line and separated from the inner guide rail member 28, and both the inner rail member 28 and the outer rail member 29 are eventually bent inwardly respectively with radiuses of curvature $R_1$ and $R_2$ in the form of arcs. Each arc is equal to a quarter of a circle, such that the extensions of the inner and outer rail members are extended further inwardly to become perpendicular to the later sides of the sun parlor and to form an upper door storage section 38 of the related door storage area.

It should be noted that the radius of curvature $R_1$ of the inner guide rail member 28 takes a value which is different from that of the radius of curvature $R_2$ of the outer guide rail member 29, $R_2$ being larger than $R_1$. In the present embodiment, the radiuses of curvature $R_2$ and $R_1$ respectively of the outer and inner guide rail members 29 and 28 are 200R and 150R, i.e. $R_2$ is 1.33 times or one-third greater than $R_1$.

The separated inner and outer rail members 28 and 29 become, after being bent respectively with radiuses of curvature of $R_1$ and $R_2$, parallel to each other at a spacing $\mathbf{1}_2$ which is slightly smaller than the distance $\mathbf{1}_1$ between the suspension rollers 20 and 21 of a panel 9. For example, $\mathbf{1}_1$ is 451 mm and $\mathbf{1}_2$ is 440 mm in this embodiment, the difference being 11 mm, without considering any play that can occur in either or both of the two suspension rollers.

Due to the fact that the distance $\mathbf{1}_2$ between the two rail members 28 and 29 in a door storage area is defined as above, i.e. to be smaller than the distance $\mathbf{1}_1$ between the two suspension rollers 20 and 21 by a small amount, and that both the upper guide rail members 28 and 29 are inwardly bent respectively with radiuses of curvature $R_1$ and $R_2$, each to form an arc equal to a quarter of a circle, whenever a panel 9 is brought to the related terminal area of the upper guide rail 26, the front suspension roller 21 always goes into the rounded area with the radius of curvature $R_2$ in advance of the rear suspension roller 20, so that the panel 9 starts its lateral displacement toward the inside of the sun parlor with the rear suspension roller 20 held by the upper guide rail 26. Consequently the panel 9 is brought to a slightly twisted state with its trailing end facing outwardly. As the trailing end of the panel 9 reaches the curved area of the inner rail member 28, it enters the upper door storage section 38 perpendicularly extending from the upper guide rail 26, maintaining the above discussed twisted state so that it may be pushed further into the storage area or pulled back to the upper guide rail 26 without jolting.

On the other hand at each opposite end of the lower guide rail 30, the inner side wall 31 and the outer side wall 32 are separated from each other by resin curved members 44 and 42 and a number of straight members 45 having an L-shaped section to form a lower door storage section, generally indicated by reference numeral 41, perpendicularly extending from the lower guide rail 30 and having a configuration corresponding to the upper door storage section 38.

As in the case of the upper door storage section, the radius of curvature of the curved member 42 has a value which is different from that of the curved member 44. However, between the end of the lower guide rail 30 and the curved member 44 which is combined with the inner side wall 31, there is arranged an angular branch member 43 so that the vertical rollers 24 and 25 provided on the free bottom of the suspended panel 9 may be unmistakably guided into their respective tracks.

Reference numeral 46 denotes a door driving roller driven by a motor 47 rigidly arranged near the upper door storage section 38 and accommodated in a case 48. Reference numeral 49 denotes a pinch roller for holding a panel in a pinched condition in cooperation with the driving roller 46, while reference numeral 50 denotes a case for the pinch roller 49. The driving roller 46 is provided with a number of small axial grooves on its periphery to make the roller a sort of pinion which comes into engagement with a rack plate 16 rigidly fitted onto the inner lateral side of the upper member 10 of each panel 9 and extending all along the member 10 in order to avoid idle rotation of the driving roller 46 that can result in an ineffective panel moving operation. Reference numeral 5 denotes a balustrade, reference numeral 6 denotes a folding door provided at the outside of the upper and lower door storage sections 38 and 41 to form a doorway when the collapsible double door assembly is completely closed, and reference numeral 7 denotes the floor of the sun parlor, while reference numerals 39 and 40 respectively denote door stoppers provided at the ends of each upper door storage section 38 and holder beams for rigidly supporting or reinforcing the upper door storage sections 38.

While this embodiment is described with reference to the accompanying drawings, illustrating U-shaped upper and lower guide rails, alternatively the guide rails may be in the form of a straight line or L-shaped with double doors arranged perpendicular to each other. Still alternatively, there may be either one or two door storage areas arranged at one or both ends of the upper and lower guide rails. A collapsible double door assembly according to the invention may also be used as a partition within a building, where the double doors may be constituted by identical panels or panels designed differently from one another.

The inner and outer rail members of the upper guide rail may be in the form of grooved rail members, a pair of suspension rollers for movably suspending a panel being guided along the respective grooves. Moreover, the rail members may be arranged vertically in parallel as in the case of the above embodiment or alternatively they may be arranged in such a manner that they are horizontally juxtaposed with the edges running side by side. While the panels of the above described embodiment are driven by a pinion roller located at the level of the suspension rollers provided at the top of the panels, the pinion roller may be located at the level of the vertical rollers provided at the bottom of the panels, or a pair of pinion rollers may be provided for driving the panels, one at the level of the suspension rollers and the other at the level of the vertical rollers.

It should be noted that the radius of curvature of the inner rail member at the storage area should not be made too small, with due consideration to the width as well as the running distance of the panel, although such radius of curvature has to be made smaller than the radius of curvature of the outer rail member. Preferably the radius of curvature of the outer rail member is between 1.2 and 1.5 times as large as that of the inner rail member.

Since the difference between the radius of curvature of the inner rail member and that of the outer rail member is a function of the distance between the two rail members in the area other than the door storage areas and the distance between the front and rear suspension rollers of a panel, the radius of curvature of the outer rail member should be made large when the panels are stored with a relatively large angle of twist in the door storage areas.

While the distance between the two parallel rail members of the upper guide rail is normally made 1 to 3 cm shorter than the span between the two tracks of the front and rear suspension rollers, such lessening can be greater than 3 cm if the radius of curvature of the inner rail member is relatively large. When the distance between the rail members is relatively small, smooth movement of the sliding doors is enhanced and the radius of curvature of the inner rail member in the door storage area is reduced, and hence the overall length of the door storage area extending from the guide rails is reduced.

A pair of suspension rollers which are rotatably arranged on the top of a panel may be so arranged that the posts of such rollers are deviated from the axial center line of the upper member and the rollers are pivotal by 90°, that adjacent of the panels are connected by plural link devices provided at the top or bottom of the panels and slidable along the adjacent panels, or that the guide rail members are integrally formed and connected with independent members for separation at the door storage areas. Moreover, many other alterations and modifications can be made to the panels, the suspension rollers, the guide rails, the door storage sections of the illustrated embodiment in terms of material, configuration, structure and dimensions, without departing the spirit and scope of the invention and, a collapsible double door assembly according to the invention may find various applications other than for a sun parlor as described above.

As is apparent from the above description, a collapsible double door assembly according to the invention comprises a number of serially connected panels each provided with a pair of inwardly and outwardly deviated pivotal suspension rollers, a horizontal guide rail constituted by an inner rail member and an outer rail member arranged in parallel in close proximity for separately guiding the suspension rollers, and one or two door storage areas extending perpendicularly from the guide rail at one or both ends thereof and formed by separating and independently bending the two rail members with different radiuses of curvature each defining an arc of a quarter of a circle. The radius of curvature of the outer rail member is relatively greater than that of the inner rail member. The distance between the two rail members in a door storage area is slightly smaller than the distance between the two suspension rollers of a panel. Each panel of the double doors can be freely twisted by independently varying the angle of pivotal movement of each of the suspension rollers of the panel without imparting an undesirable load to the suspension rollers that would take place when the two rollers are pivoted simultaneously at the same rate. Consequently, the panels can be moved into or pulled out of the storage areas very smoothly, particularly because the panels are stored in the storage areas in a slightly twisted state.

Since a door storage area is extended perpendicularly from the upper and lower guide rails, it can be realized in the form of an oblong or square as viewed from above, thereby minimizing the space required to accommodate a given number of collapsed panels.

Therefore, a collapsible double door assembly according to the invention has, among others, an effect of realizing door storage areas perpendicularly extending from the upper and lower guide rails and which are ideal in terms of position, configuration and dimensions, as well as an effect of offering door storage areas that enable the door panels to be smoothly moved into or out of the areas, with the panels being stored in a totally collapsed condition.

What is claimed is:

1. A collapsible door assembly comprising:

a horizontally extending longitudinal guide rail including an outer rail member and an inner rail member parallel and in close proximity to said outer rail member;

a plurality of individual door panels that are serially connected, each said door panel having first and second horizontally spaced rollers directed toward respective opposite sides of said panel;

said panels being supported by said guide rail with said first roller of each panel guided by said outer rail member and with said second roller of each panel guided by said inner rail member, whereby said panels are movable along said guide rail; and a storage means at a first end of said guide rail for storing said panels in adjacent parallel alignment, said storage means comprising continuations of said outer and inner rail members curving therefrom at separate spaced locations along said guide rail, each said continuation including a curved portion in the form of an arc defining a quarter of a circle and a rectilinear portion extending perpendicular to said guide rail, said curved portion of said continuation of said outer rail member having a radius of curvature greater than that of said curved portion of said continuation of said inner rail member, and said rectilinear portions being spaced by a distance less than the distance between said first and second rollers of said panels.

2. An assembly as claimed in claim 1, wherein said first and second rollers are positioned to extend upwardly from respective said panels, said guide rail is mounted above said panels, and said rollers are suspended from respective said rail members.

3. An assembly as claimed in claim 2, further comprising roller supports for supporting said rollers from upper portions of respective said panels, each said roller support comprising a shaft including a vertical portion mounted in the respective panel for rotation about a vertical axis and a horizontal portion extending laterally outwardly from said vertical portion, the respective said roller being rotatably mounted about said horizontal portion.

4. An assembly as claimed in claim 1, wherein said assembly is a double door assembly including two pluralities of said door panels, said guide rail has at each of opposite ends thereof a respective said storage means, and said two pluralities of door panels are individually movable into respective of said storage means.

5. An assembly as claimed in claim 1, wherein said radius of curvature of said curved portion of said continuation of said outer rail member is from 1.2 to 1.5 times the radius of curvature of said curved portion of said continuation of said inner rail member.

* * * * *